US006693552B1

(12) United States Patent
Herzig et al.

(10) Patent No.: US 6,693,552 B1
(45) Date of Patent: Feb. 17, 2004

(54) HAND-HELD CONTROL DEVICE

(75) Inventors: Fried-Helm Herzig, Bad Oeynhausen (DE); Martin Ctvrtnicek, Bünde (DE)

(73) Assignee: Dewert Antriebs- und Systemtechnik GmbH & Co. KG, Kirchlengern (DE)

( * ) Notice: Subject to any disclaimer, the term of this patent is extended or adjusted under 35 U.S.C. 154(b) by 300 days.

(21) Appl. No.: 09/636,712

(22) Filed: Aug. 11, 2000

(30) Foreign Application Priority Data

Aug. 13, 1999 (DE) ..... 299 14 191 U

(51) Int. Cl.[7] ..... G08C 19/00

(52) U.S. Cl. ..... 340/825.72; 340/825.22; 340/455; 341/176; 361/755

(58) Field of Search ..... 340/825.72, 825.22, 340/825.69, 5.61, 5.64, 455; 349/58; 294/905; 341/176; 361/730, 755, 752

(56) References Cited

U.S. PATENT DOCUMENTS 4,046,982 A * 9/1977 Schadow et al. ..... 200/159
4,609,119 A * 9/1986 Richter, Sr. ..... 220/3.5
5,373,458 A * 12/1994 Bishay et al. ..... 364/708
5,644,461 A * 7/1997 Miller et al. ..... 361/56
5,989,708 A * 11/1999 Kreckel ..... 428/354
6,008,598 A * 12/1999 Luff et al. ..... 318/16
6,155,617 A * 12/2000 Kuenzel ..... 292/318
6,195,141 B1 * 2/2001 Kawano et al. ..... 349/58

* cited by examiner

*Primary Examiner*—Brian Zimmerman
*Assistant Examiner*—Vernal Brown
(74) *Attorney, Agent, or Firm*—Henry M. Feiereisen

(57) ABSTRACT

A hand-held control device for controlling a drive having one or more d.c. motors and/or a.c. motors for adjusting a piece of furniture, includes a housing having a lower housing part and an upper housing part. A circuit board is received in the housing and has switch elements. Further accommodated in the housing is a battery pack for providing emergency power supply for operation of drive functions and/or power supply for operating the hand-held control device. A cable and/or an infrared transmitter unit operatively connects the hand-held control device with the drive, wherein the circuit board and/or the upper housing part is securable to the lower housing part in at least two positions.

25 Claims, 7 Drawing Sheets

10
13
15
17
58
19
11
9b
21b
5
21a
9a
3
1
7

20
25
11
21b
23
9a
1

3
15
11
1
35
30
9b
33
27
9a 27
29b
33
29a
31

27
25
21b
23
33
29a
31
9a

HAND-HELD CONTROL DEVICE

CROSS-REFERENCES TO RELATED APPLICATIONS

This application claims the priority of German Patent Application, Serial No. 299 14 191.8, filed Aug. 13, 1999, the subject matter of which is incorporated herein by reference.

BACKGROUND OF THE INVENTION

The present invention relates, in general, to a hand-held control device for adjustment of a piece of furniture.

Hand-held control devices are used for controlling drives for pieces of furniture with at least one drive motor, and a power supply directly fed from the power outlet or via a transformer or via a battery/accumulator. The drives may be equipped with one or more d.c. motors and/or a.c. motors which may be operated by various types of hand-held control devices via a control unit, e.g. relay and/or semiconductor devices etc., to turn or move the piece of furniture in different directions.

A hand-held control device represents a furniture drive component which remains visible after installation and thus permanently affects the outer look. Typically, hand-held control devices are attached to the drive by a cable and secured in place in various fashions. Examples of hand-held control devices are described, for example, in German utility models G 8804417, G 9318083 and G 29507947. In general, hand-held control devices are intended to implement many functions. Thus, many different designs have been proposed which vary not only in function but also in shape, color, imprint, ease of operation, noise level etc. As a result of using many different components, stock keeping is complicated and manufacturing costs are high, rendering conventional hand-held control devices rather cost-intensive. Oftentimes, the end consumer desires after purchase at some later time to replace the delivered hand-held control device. This becomes difficult because it is nearly impossible to identify the correct type and to find a matching and correctly operating alternative, when taking into account the many variations and connection types of existing hand-held control devices. In addition, it is uncommon to replace a wired hand-held control device by, e.g., a hand-held control device that is based on an infrared operation and has an identical keypad and/or operating elements.

SUMMARY OF THE INVENTION

It is thus an object of the present invention to provide an improved hand-held control device, obviating the aforestated drawbacks.

In particular, it is an object of the present invention to provide an improved hand-held control device which is easy to produce and offers the user a wide variety of applications, while yet being reliable in operation.

These objects, and others which will become apparent hereinafter, are attained in accordance with the present invention by providing a housing having a lower housing part and an upper housing part; a circuit board received in the housing and having switch elements; a battery pack received in the housing for providing emergency power supply for operation of drive functions and/or power supply for operating the hand-held control device; and a cable or an infrared transmitter for operatively connecting the hand-held control device with the drive being controlled, wherein the circuit board and/or the upper housing part is securable to the lower housing part in at least two positions of installation.

According to another feature of the present invention, the circuit board may include a first electromechanical connector for connection to a complementary second electromechanical connector disposed in the lower housing part. Suitably, the second electromechanical connector is so configured in shape and electric circuiting as to allow placement and detachable clipped securement of the upper housing part. In particular, the circuit board and/or the upper housing part can be latched to the lower housing part in two positions that differ by an angle of 180° so as to maintain control functions designated on a keypad on the upper housing part.

The hand-held control device can be assembled with a minimum number of standardized components that can easily be produced so that a customized production with constantly different tools is avoided. The single components are assembled to form separate modules which can be put together according to a customer's order and then clipped together for shipment, or shipped directly. The customer received the hand-held control device as kit that allows the customer to assemble the hand-held control device to suit the demands at hand. The hand-held control device can realize a number of functions in wired mode as well as in wireless mode by using the same mechanical components, whereby the control panel or keypad will normally not change. The upper housing part may have different designs and, to some extent, different control configurations, while the lower housing part and the circuit board remain the same.

The upper and lower housing parts can be combined mechanically as well as electrically, whereby the upper housing part can be clipped to the lower housing part in addition in a 180° rotated disposition.

According to another feature of the present invention, a cover sheet may be glued to the upper housing part for sealing purposes. It is also possible to provide the upper housing part and the lower housing part with a sealing lip, which may be made by a two-component injection molding process for realizing a high degree of sealing action (so called IP-protection type or ingress protection). The surface film, applied on the upper housing part at suitable locations, in conjunction with the two-component overlapping configuration between confronting ends of the upper and lower housing parts, realizes a particularly high degree of tightness (IP-type) of the hand-held control device.

According to another feature of the present invention, the upper housing part is provided with switching zones having keys integrated with the upper housing part. The keys may have a joint-forming notch to transmit an actuation pressure upon the switch elements.

The lower housing part may be provided with or without cable and has a compartment with two receptacles for accommodating two batteries/accumulators, respectively, for emergency operation in the event of, for example, a power failure, whereby a particularly small and powerful self-resetting electric fuse may be incorporated for the batteries. Thus, during a power failure, the drive for the piece of furniture may still be adjusted by the hand-held control device by tapping the batteries. When configuring the hand-held control device for wireless operation, only one battery is fitted in one of the receptacles for operating the transmitter unit which is fitted in the other one of the receptacles that is disposed adjacent an opening intended for entry of the cable when desiring to convert the hand-held control device for wired mode. When operating the hand-held control device in wireless mode, the opening is sealed by a plug that is transparent to infrared light, and the infrared transmitter is placed directly behind this plug. The use of a single battery in wireless mode is sufficient to operate the piece of furniture in the event of a power failure.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1A:
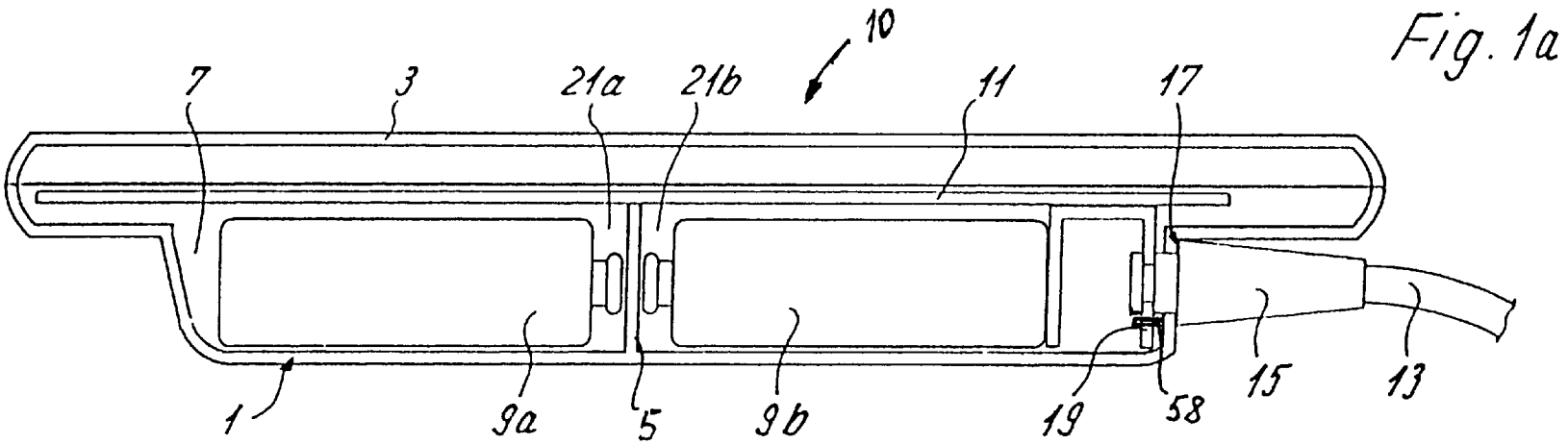
FIG. 1*a* is a longitudinal section of a basic configuration of a first embodiment of a hand-held control device according to the present invention, operating in wired mode.

Throughout all the Figures, same or corresponding elements are generally indicated by same reference numerals.

Turning now to the drawing, and in particular to FIG. 1*a*, there is shown a longitudinal section of a basic configuration of a hand-held control device according to the present invention, generally designated by reference numeral 10 and controlling functions of a drive 100 (FIG. 5) having one or more d.c. motors and/or a.c. motors for positionally adjusting a piece of furniture. The hand-held control device 10 includes a housing having a lower housing part 1 and an upper housing part 3 which can be latched onto the lower housing part 1 and is substantially configured as a flat lid. The lower housing part 1 is outwardly recessed to form a compartment 7 which is separated by a conductive partition wall 5 into two receptacles 21*a*, 21*b* for accommodating a battery pack, e.g. conventional 9V batteries 9*a*, 9*b* placed coaxially behind one another. Connected to the battery pack is a cable 15 which enters through an opening 17 at the right hand side of the lower housing part 1 via a strain relieve element 15 and is held in place by a conductive clamp 19. Suitably, the lower housing part 1 is formed with ridges and recesses, indicated at reference numeral 58 to guide the clamp 19 perpendicular to the cable 13 and to secure the clamp 19 in its end position for clamping the cable 13. In addition to the battery pack, the lower housing part 1 accommodates a printed circuit board 11 which can be clipped onto the upper housing part 3.

Figure 1B:
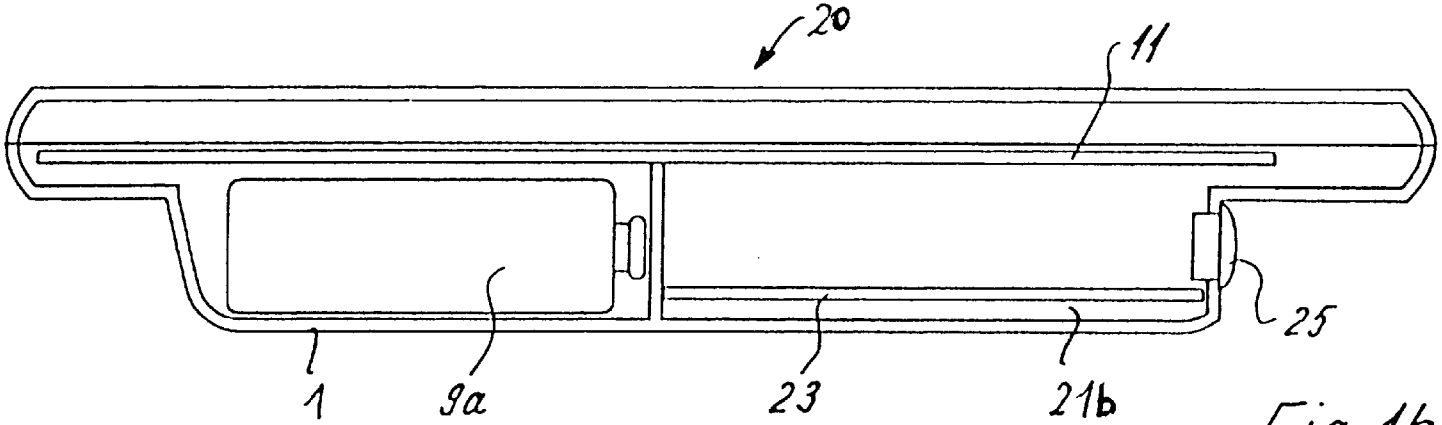
FIG. 1*b* is a longitudinal section of a basic configuration of a second embodiment of a hand-held control device according to the present invention operating in wireless mode.

FIG. 1*b* shows another type of a hand-held control device according to the present invention, generally designated by reference numeral 20 and differing form the hand-held control device 10 by the selected mode of operation. Parts corresponding with those in FIG. 1*a* are denoted by identical reference numerals and not explained again. In this embodiment, provision is made for a wireless operation, instead of the wired cable connection shown in FIG. 1*a*. The wireless operation is implemented by incorporating an infrared transmitter or printed transmitter circuit board 23 which is replaces the battery 9*b* in the receptacle 21*b* adjacent the opening 17. The opening 17 is hereby sealed by an infrared component or plug 25 which is transparent to infrared light.

Figures 2A, 2B, 2C:
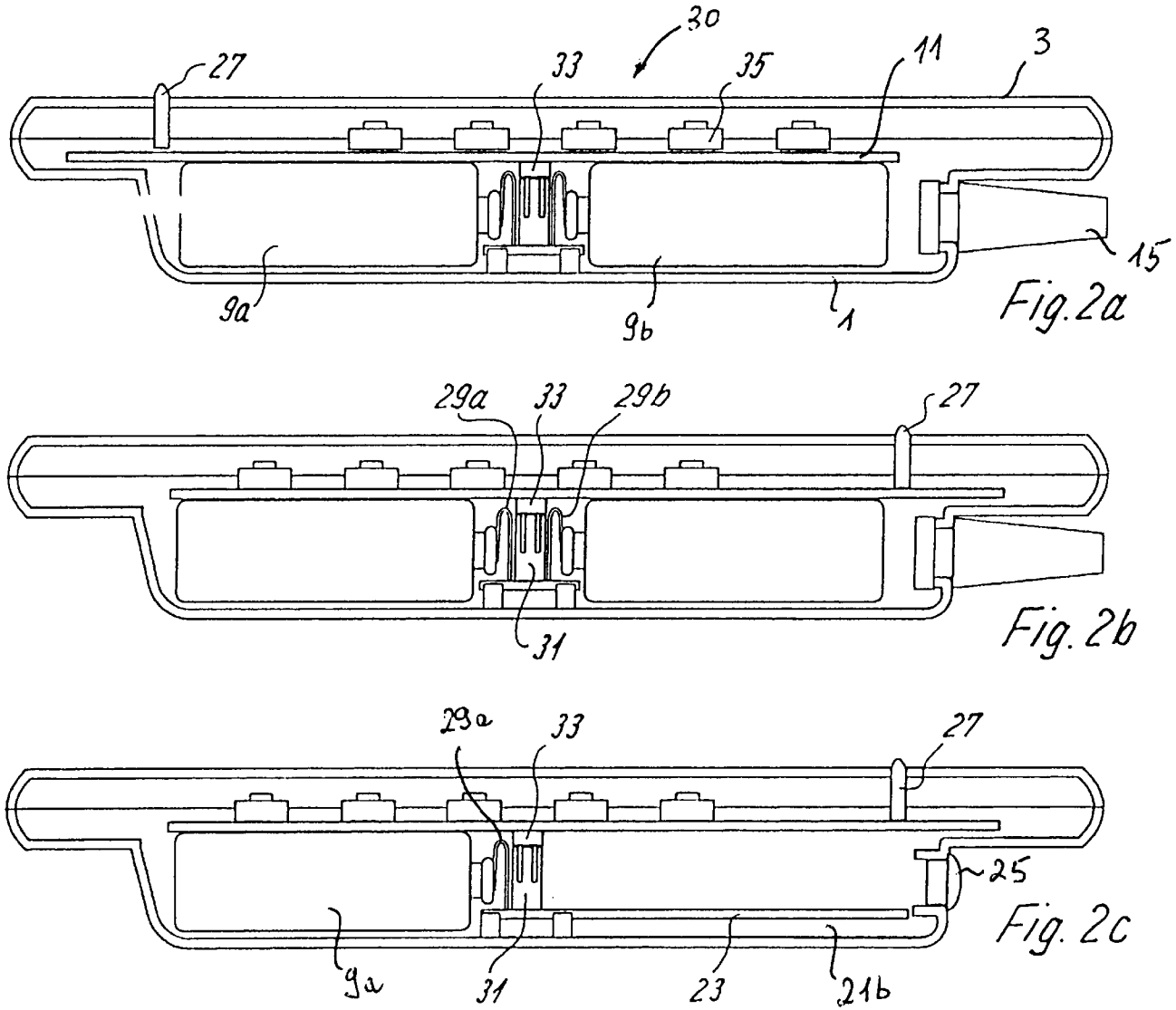
FIG. 2*a* is a longitudinal section of a modified hand-held control device of FIG. 1*a;*
FIG. 2*b* is a longitudinal section of the hand-held control device of FIG. 2*a* in 180° rotated position of the upper housing part.
FIG. 2*c* is a longitudinal section of a modified hand-held control device of FIG. 1*b;*

FIG. 2*a* is a longitudinal section of a modification of the hand-held control device of FIG. 1*a*, generally designated by reference numeral 30 and substantially corresponding to the configuration of the hand-held control device 10 of FIG. 1*a*. The hand-held control device 30 is provided at the left upper region with a indicator lamp 27 which is operatively connected to the circuit board 11 and indicates the state of operation of the hand-held control device 30.

In accordance with the present invention, the upper housing part 3 and the circuit board 11 are so suited to one another as to allow an attachment to the lower housing part 1 in two positions of installation that are rotated by 180°, as shown in FIG. 2*b* in which the upper housing part 3 with the circuit board 11 are in 180° rotated disposition compared to the illustration of FIG. 2*a*. The provision of two batteries 9*a*, 9*b* in this mode of operation is preferred as an energy source for emergency dip is realized which is more powerful than the use of only a single battery.

Figure 3A:
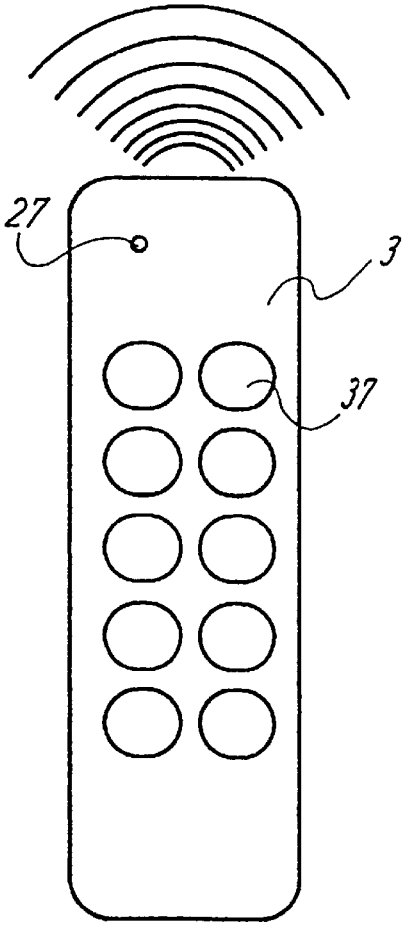
FIGS. 3*a*, 3*b* are schematic illustrations of the keypad of the upper housing part of the hand-held control device according to FIGS. 2*c* and 2*a*, respectively.
Figure 3B:
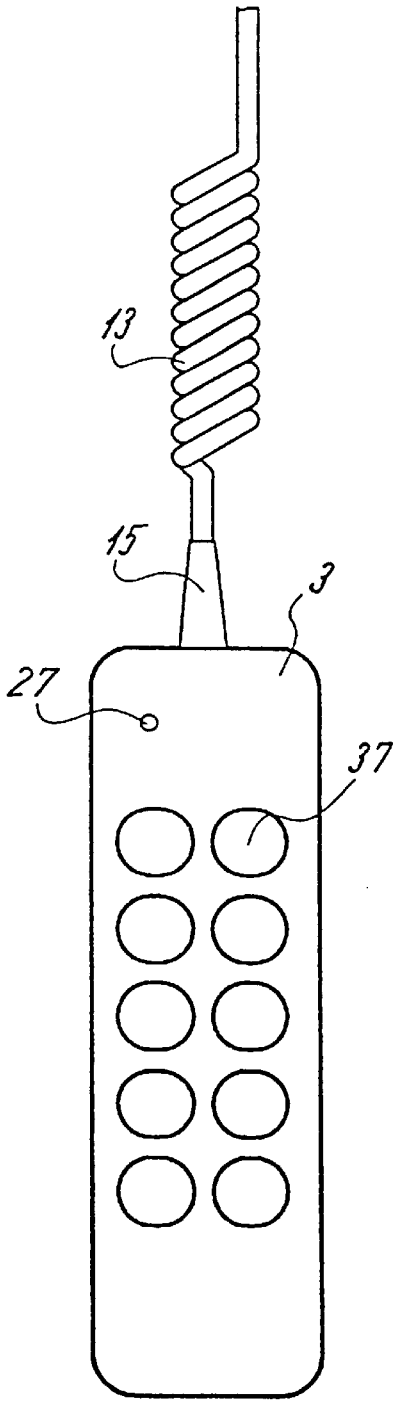

The electric connection of the batteries 9*a*, 9*b* is implemented by suitable terminals 29*a*, 29*b* which are in contact with a socket 31 of the lower housing part 1 for plugged engagement of a connector 33 of the circuit board 11. The connector 33 is so received in the socket 31 as to be able to rotate therein by 180° and is in direct contact with tracks (not shown) on the back of the circuit board 11. The front of the circuit board 11 contains switch elements 35 which, as shown by way of example in FIG. 3*b*, are activated by a keypad 37 integrated in the upper housing part 3. In relation to the keypad 37, the cable 13 (only strain relief element 15 is shown in FIGS. 2*a*, 2*b* for sake of simplicity) thus enters the housing of the hand-held control device 30 according to FIG. 2*a* from "below" whereas in the configuration of FIG. 2*b*, the cable 13 enters the hand-held control device 30 from "above" with respect to the keypad 37. These dispositions will be described in more detail further below with reference to FIG. 5.

A modification of the wired hand-held control device 30 from wired mode to a hand-held control device 20 operating in infrared mode is shown in FIG. 2*c*. The modification can easily be carried out by replacing the battery 9*b* with the transmitter board 23 in the receptacle 21*b* and, after detaching the cable 13, sealing the opening 17 with the plug 25. The electric connection of the battery 9*a* with the transmitter board 23 is implemented by the terminal 29*a* which is in electric contact with the socket 31 of the lower housing part 1 for engagement of the connector 33 of the circuit board 11. The connector 33 is again received in the socket 31 for rotation about 180° and is in direct contact with the tracks (not shown) on the back of the circuit board 11. The keypad 37 integrated in the upper housing part 3 activates the switch elements 35 on the front of the circuit board 11, as shown by way of example in FIG. 3*a*.

Figure 4:
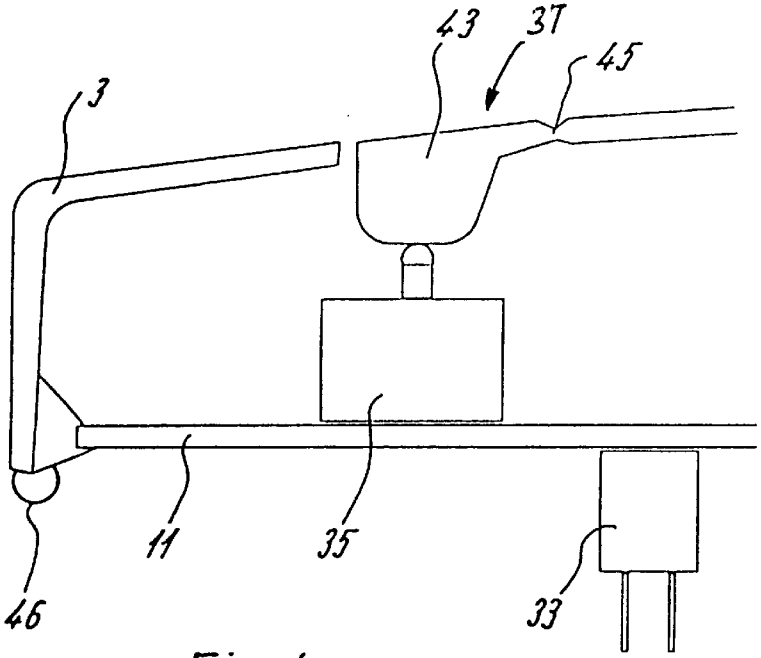
FIG. 4 is a sectional view of the upper housing part of the hand-held control device.

Referring now to FIG. 4, there is shown that the keypad 37 has keys 43 which are formed integrally in the upper housing part 3. Each key 43 includes a joint-forming notch 45 so that an actuation of the keypad 37 by pressing an intended key 43 is transmitted onto the interacting switch element 35 located on the circuit board 11. The circuit board 11 is, as stated above, clipped into the upper housing part 3, whereby the indicator lamp 27 is projects out through an opening in the upper housing part 3 or can be flush-mounted with the upper housing part 3.

Figure 9:
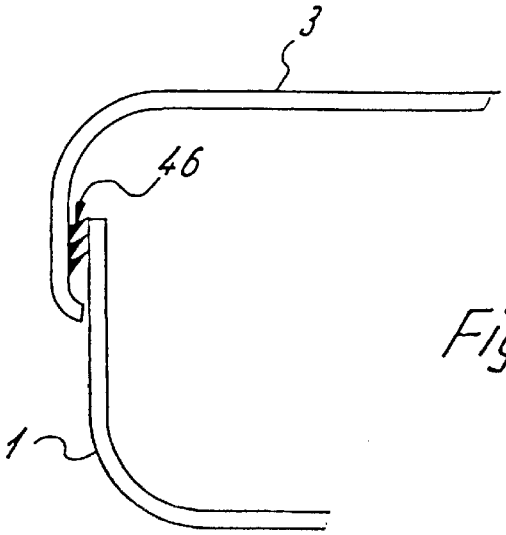
FIG. 9 is a schematic illustration of a sealed connection between upper and lower housing parts.
Figure 10:
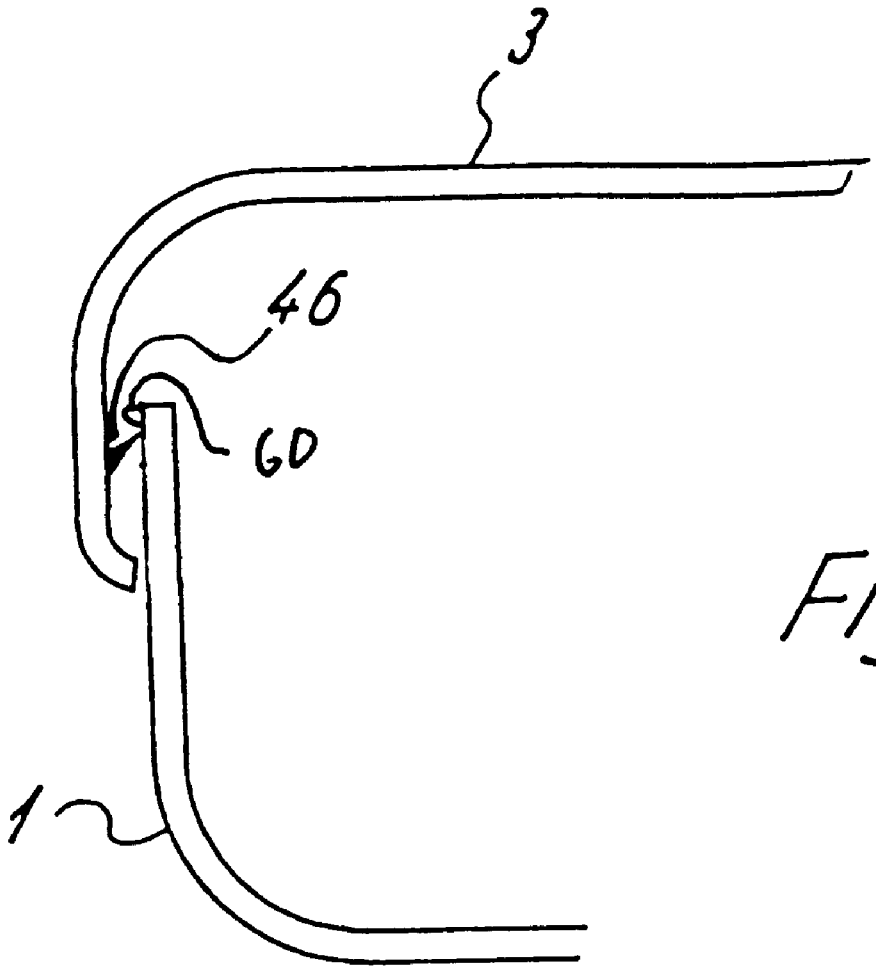
FIG. 10 is an exemplified schematic illustration of a securement between upper and lower housing parts.

The upper housing part 3 forms with the circuit board 11 a module which can be clipped to the lower housing part 1 such that the upper housing part 3 overlaps the lower housing part 1, as shown in FIG. 9. The overlap between confronting ends of the upper housing part 3 and the lower housing part 1 results in a tight fit. Suitably, as shown in FIG. 9, a sealing lip 46 is formed between the housing parts 1, 3 and implemented through a two-component injection molding technique. Optionally, the keypad 37 with the keys 43 of the upper housing part 3 may be covered by a film, thereby attaining a particularly high degree of tightness (IP-type) of the entire hand-held control device. As the housing parts 1, 3 snap easily together or can easily be detached from one another, a user can assemble and disassemble the housing without any need for tools. A securement between the housing parts 1, 3 is shown by way of example only in FIG. 10. As illustrated therein, the lower housing part 1 is provided with a protrusion or knob 60 which engages behind the inturned extremity of the upper housing part 3.

Figure 5:
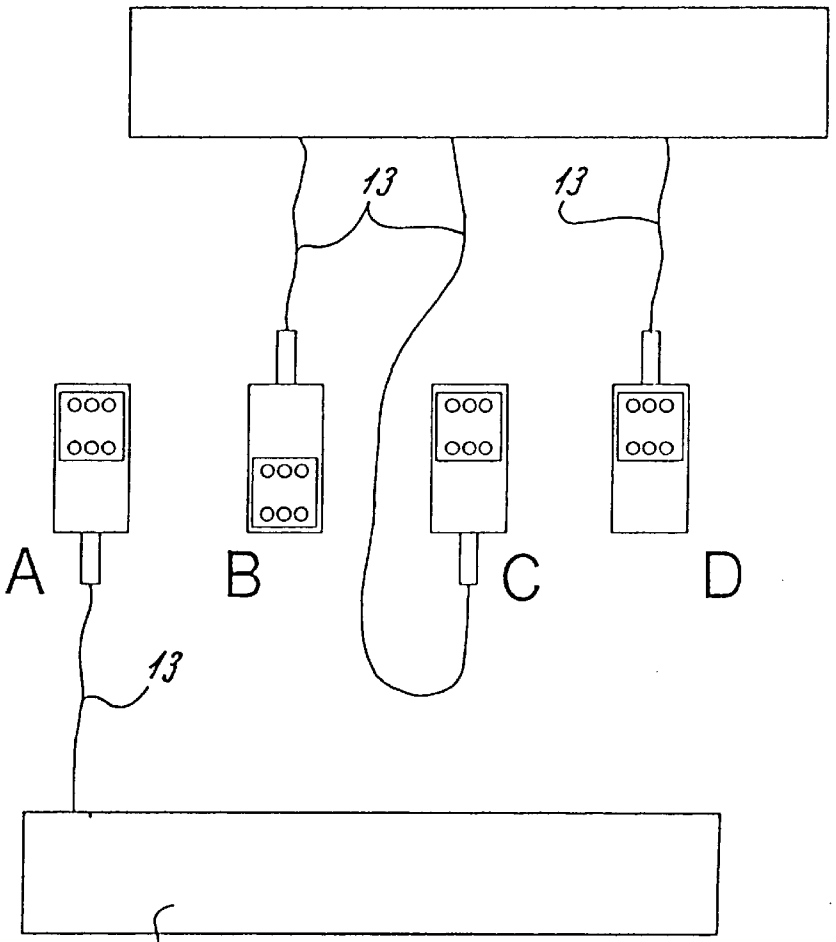
FIG. 5 shows schematic illustrations of various cable outlets.

The attachment of the upper housing part 3 to the lower housing part 1 can be realized in two positions rotated by 180°, whereby the keypad 37 and the switch elements 35 retain their correspondence accordingly. This is advantageous in particular in those situations in which the cable 13 exits the hand-held control device from above instead from below in relation to the keypad 37. Reference is made to FIG. 5, whereby illustration A depicts the cable 13 entering from below, which means that the hand-held control device can be easily handled, Illustration B shows the cable entering from above which disposition is not desired so that the hand-held control device should be turned into a disposition shown in illustration C in which the keypad 37 is located above for better handling by a user. Hereby, the cable 13 could be extended and pulled out, as shown, to prevent the mechanical tension of the cable 13 from inadvertently spinning the hand-held control device in the user's hand. However, it is also possible to simply turn the upper housing part 3 by 180° and then to clip it to the lower housing part 1. Illustration D shows the cable guided from above and entering the hand-held control device from above. This results in a desired position of the hand-held control device with respect to the user.

Figure 6:
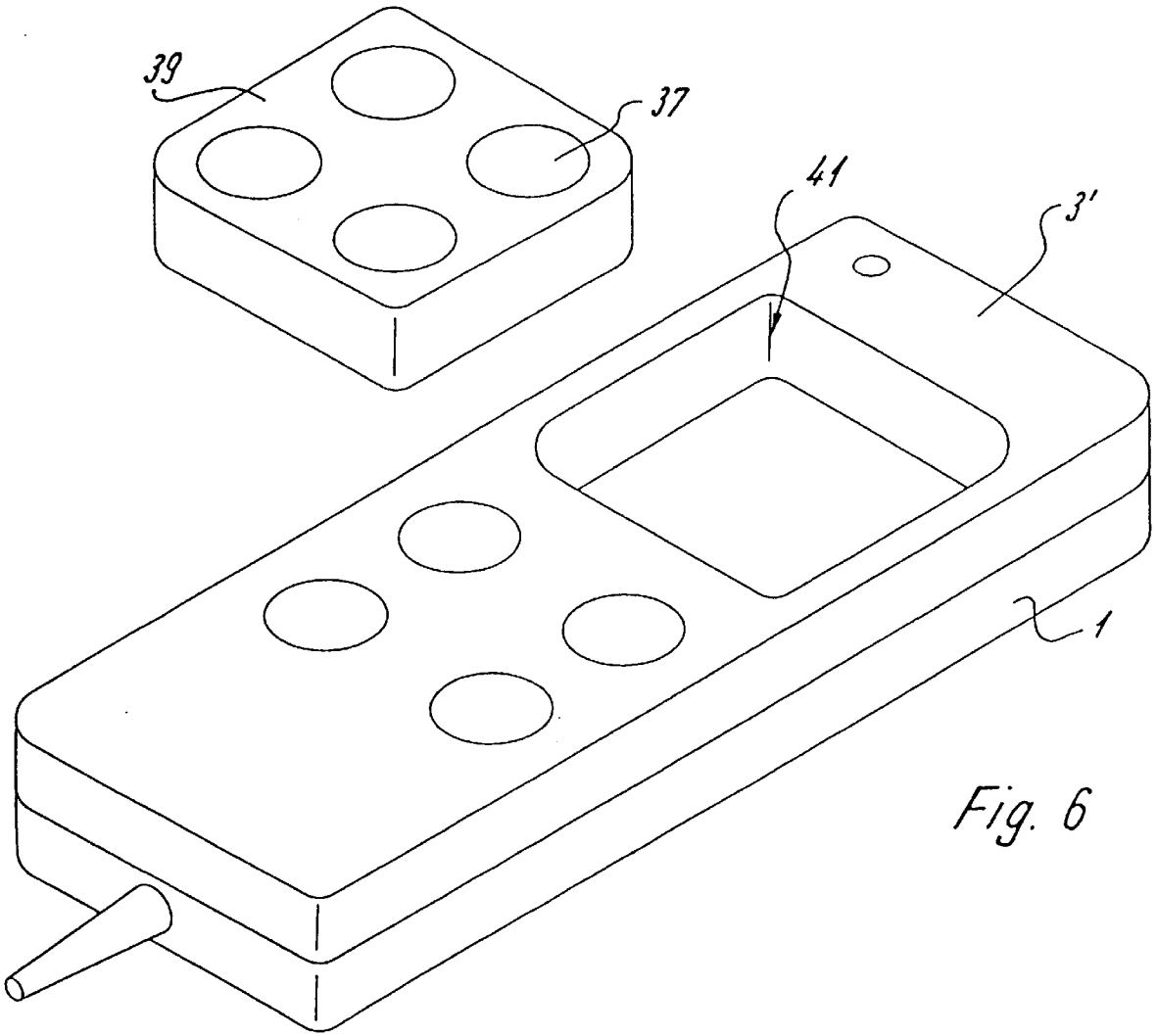
FIG. 6 is a perspective view of a modular configuration of the upper housing part of a still another embodiment of a hand-held control device according to the present invention.

FIG. 6 shows a modular configuration of the upper housing part 3 in the form of two portions, with a main body 3' formed with a bay 41 and having a keypad 37 for executing certain control functions, and a module 39 which has a configuration that complements the outline of the bay 41 and has also a keypad 37 for executing other control function. Thus, the module 39 can be placed into the bay 41 for electric connection with the circuit board 11, or detached from the bay 41. In this fashion, a simple child safety mechanism is established and, in a simple manner, some functions can be removed from the hand-held control device.

Figure 7:
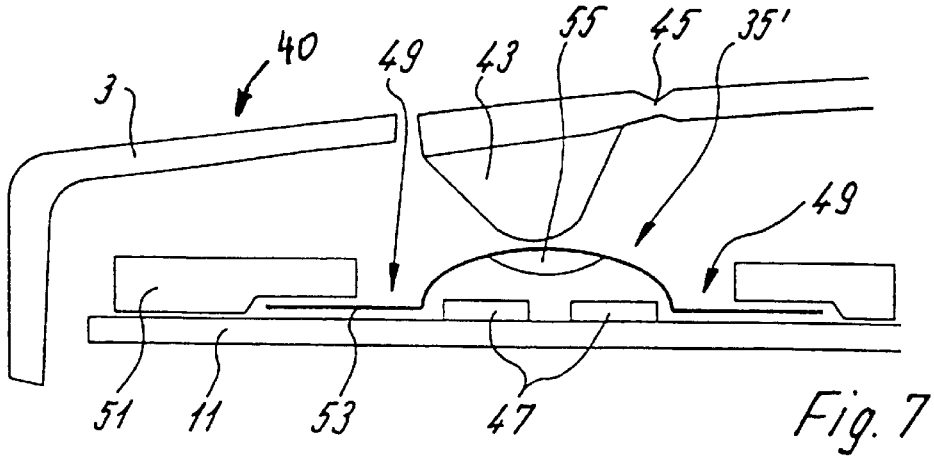
FIG. 7 is a sectional view of an upper housing part of a yet another embodiment of a hand-held control device according to the present invention.

FIG. 7 shows another embodiment of a hand-held control device according to the present invention, generally designated by reference numeral 40, and including switch elements 35' which include contact disks 53 disposed in recesses 49 of a retainer sheet 51 glued to the circuit board 11. Actuation of the switch elements 35' is realized by pressing down the contact disks 53 which are each formed at the back with a contact lug 55 for electrically connecting mating contacts 47 (e.g. tracks) with one another.

Figure 8:
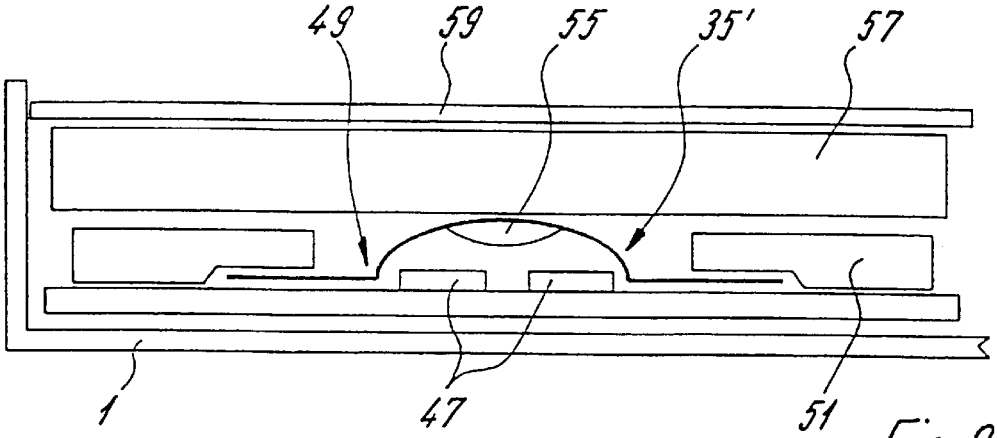
FIG. 8 is a sectional view of an upper housing part of a yet another embodiment of a hand-held control device according to the present invention.

FIG. 8 shows a variation of the hand-held control device 40 with the difference residing in the provision of an intermediate layer 57 upon the switch elements 35', and of a sheet 59 glued onto the intermediate layer 57. In the area of the switch elements 35', the sheet 59 is imprinted with data. A pressure applied by the touch of a finger on the sheet 59 is transmitted via the intermediate layer 57 onto the switch elements 35'. The size and the elasticity of the intermediate layer 57, the sheet 59 and the switch elements 35' can be varied within certain limits to alter the feel of the switching action and switching noises. This configuration is advantageous because apart from the flat and compact structure, the kit of the hand-held control device may contain a certain selection of sheets 59 for the user to design according to the user's wishes. Imprinting with user-specific designations generated by computer and conventional printers is feasible.

While the invention has been illustrated and described as embodied in a hand-held control device, it is not intended to be limited to the details shown since various modifications and structural changes may be made without departing in any way from the spirit of the present invention.

What is claimed as new and desired to be protected by Letters Patent is set forth in the appended claims:

1. A hand-held control device for controlling a drive having one or more d.c. motors and/or a.c. motors for adjusting a piece of furniture, said hand-held control device comprising:

a housing having a lower housing part, which has an opening, and an upper housing part, which has a keypad with a number of keys;

a circuit board received in the lower housing part and connected to the upper housing part, said circuit board having switch elements actuatable by the keypad of the upper housing part, whereby the keys and the switching elements are placed into one-to-one correspondence;

a battery pack received in the housing for providing emergency power supply for operation of drive functions and/or power supply for operating the hand-held control device; and connecting means associated to the opening and operatively linking the hand-held control device with the drive, wherein the upper housing part with the attached circuit board is rotatable in relation to the lower housing part for attachment of the upper housing part with the attached circuit board to the lower housing part in two positions rotated by 180° while retaining control functions of the switch elements when the keypad is actuated, so as to enable a user to operate the keypad in a user-friendly disposition.

2. The hand-held control device of claim 1 wherein the connecting means includes at least one of a cable for passage through the opening, and an infrared transmitter for passage of infrared light through the opening.

3. The hand-held control device of claim 1 wherein the circuit board includes a first electromechanical connector for connection to a complementary second electromechanical connector disposed in the lower housing part.

4. The hand-held control device of claim 3 wherein the circuit board is destined for clipped securement to the upper housing part, said lower housing part having a shape and an electric circuiting as to allow placement and detachable clipped securement thereto of the upper housing part.

5. The hand-held control device of claim 2, and further comprising a clamp for securing the cable in the lower housing part.

6. The hand-held control device of claim 5 wherein the lower housing part has ridges and recesses which guide the clamp perpendicular to the cable and are so configured as to fix the clamp in its end position for clamping the cable.

7. The hand-held control device of claim 1, and further comprising a surface film glued to and sealing the upper housing part.

8. The hand-held control device of claim 1 wherein the upper housing part is made of at least two portions, with one of the portions representing at least part of the keypad which is removable from the remaining portion of the upper housing part.

9. The hand-held control device of claim 3, and further comprising a wireless control mechanism including a transmitter circuit board disposed in the lower housing part at a distance to the circuit board and electrically connected to the circuit board via the first and second connectors, and a plug transparent to infrared light for closing the opening.

10. The hand-held control device of claim 1 wherein the upper housing part and the lower housing part have a sealing lip.

11. The hand-held control device of claim 10 wherein the sealing lip is made by a two-component injection molding process for realizing a high degree of sealing action.

12. The hand-held control device of claim 1 wherein the keys of the keypad are integrated in the upper housing part.

13. The hand-held control device 12 wherein each of the keys has a joint-forming notch to transmit an actuation pressure upon the switch elements.

14. The hand-held control device of claim 1 wherein the switch elements have resilient contact disks which are disposed in recesses of a retainer sheet, glued onto the circuit board, and are sized to contact mating contacts.

15. The hand-held control device of claim 1, and further comprising a layer placed over the switch elements.

16. The hand-held control device of claim 14, and further comprising a film glued on the layer and imprinted with data in an area of the switch elements.

17. The hand-held control device of claim 1, and further comprising a self-resetting electric fuse incorporated in the lower housing part.

18. A kit for assembly of a hand-held control device useful for controlling a drive for adjusting an element, said kit comprising:

a first housing part including an opening and having a compartment with two receiving spaces, with a first one of the receiving spaces arranged distal to the opening and a second one of the receiving spaces arranged proximal to the opening a second housing part configured for connection to the first housing part in at least two different positions and having a keypad;

a circuit board received in the first housing part and having switch elements cooperating with the keypad;

a pair of batteries, at least one of the batteries intended for installation in the first receiving space of the compartment for providing emergency power supply;

a cable guided through the opening of the lower housing part for electric connection of the circuit board with the drive being controlled for implementing an operation of the hand-held control device in wired mode;

an infrared transmitter, intended for installation in the second receiving space of the compartment, for electric connection of the circuit board to the drive being controlled for implementing an operation of the hand-held control device in wireless mode; and a plug capable of sealing the opening when operating the hand-held control device in wireless mode, wherein the first housing part with the circuit board is rotatable in relation to the second housing part for attachment of the first housing part with the attached circuit board to the second housing part in two positions rotated by 180° while retaining control functions of the switch elements when the keypad is actuated so as to enable a user to operate the keypad in a user-friendly disposition.

19. The kit of claim 18 wherein the circuit board received in the first housing part is clipped to the second housing part when securing the second housing part to the first housing part.

20. The kit of claim 18, and further comprising a clamp for securing the cable in the first housing part.

21. The kit of claim 18, and further comprising a surface film glued to and sealing the second housing part.

22. The kit of claim 18 wherein the second housing part is made of at least two portions, with one of the portions representing at least part of the keypad which is removable from the remaining portion of the second housing part.

23. The kit of claim 18 wherein the keypad of the second housing part has keys, each key having a joint-forming notch to transmit an actuation pressure upon the switch elements.

24. The kit of claim 18, and further comprising a layer placed over the switch elements.

25. The kit of claim 24, and further comprising a film glued on the layer and imprinted with data in an area of the switch elements.

* * * * *